United States Patent [19]

Halford et al.

[11] Patent Number: 4,513,967

[45] Date of Patent: Apr. 30, 1985

[54] TOY VEHICLE GAME WITH LAUNCHER AND RETURN MEANS

[75] Inventors: Wayne R. Halford; Walter S. Nakano, both of Manhattan Beach, Calif.

[73] Assignee: Mattel, Inc., Hawthorne, Calif.

[21] Appl. No.: 566,591

[22] Filed: Dec. 29, 1983

[51] Int. Cl.[3] ..... A63B 67/14

[52] U.S. Cl. ..... 273/108; 273/129 V; 273/129 P; 273/86 D; 273/119 R

[58] Field of Search ..... 273/85 E, 85 R, 86 D, 273/108, 119 R

[56] References Cited

U.S. PATENT DOCUMENTS

| | | | |
|---|---|---|---|
| 1,682,645 | 9/1928 | Vollmer | 273/119 R |
| 2,441,641 | 5/1948 | McAleer | 273/108 |
| 3,145,991 | 9/1964 | Benditt | 273/108 |
| 3,713,654 | 1/1973 | Goldfarb | 273/108 |
| 3,734,500 | 5/1973 | Cooper | 273/85 R |
| 3,740,896 | 6/1973 | Glass et al. | 446/212 |
| 3,789,540 | 2/1974 | Convertine et al. | 446/180 |
| 3,936,053 | 2/1976 | Goldfarb et al. | 273/108 |
| 4,159,705 | 7/1979 | Jacoby | 124/63 |
| 4,223,472 | 9/1980 | Fekete et al. | 446/192 |
| 4,229,005 | 10/1980 | Barlow et al. | 273/86 |

*Primary Examiner*—Richard C. Pinkham
*Assistant Examiner*—Benjamin H. Layno
*Attorney, Agent, or Firm*—Ronald M. Goldman; James G. O'Neill

[57] ABSTRACT

A toy car collision set (10) in which children attempt to crash nonsteerable unpowered cars (28, 30) at an intersection (12) when travelling in either the forward or reverse directions. The set includes at least two sets of tracks (14, 16, 22, 24) connected together at the intersection (12). A launcher (18, 20) is connected at one end of each of the tracks, and includes a piston assembly (34, 38) having a 5 to 1 compression ratio to be easily operated by a child hitting or pushing the top of the launcher. At the other end of each of the tracks, an elastic return means (26, 27) returns the launched cars along their respective tracks, if the car has not crashed at the intersection. The return means includes an elastic strip (52) stretched across the track to rebound a car striking the strip back along the direction in which it came to either strike another vehicle, at the intersection, or to be returned to the launcher for another launch.

5 Claims, 6 Drawing Figures

F
35
18
36
34
33
32
3
45
44
31
46
50
48
42
38
40
28
43
14

24
26
52
5
5
54
56
22
28

26
6
54
64
60
52
62
58
56
22
68
6
66
67

64
52
60
22
66
68

TOY VEHICLE GAME WITH LAUNCHER AND RETURN MEANS

DESCRIPTION

1. Technical Field

This invention relates to toy vehicles and, more particularly, to toy vehicle crash sets in which nonsteerable, unpowered toy vehicles launched by different players may be made to selectively crash into each other.

2. Background Art

Toy vehicle play sets in which self propelled toy vehicles, for example, automobiles, traverse a miniature roadway and are crashed into each other for demolition purposes are known. One such game is set forth in U.S. Pat. No. 3,734,500 in which two self propelled toy vehicles, having crash indicating means built into the vehicles, are steered and controlled by individual players and caused to crash into each other at one or more intersections. A winner is determined by indication means on the struck vehicle only being activated.

Also known are various toy automobiles which are propelled by means of fluid flow. This fluid flow may be either directed toward the automobile, a turbine mounted within the automobile, or by means of pressurized fluid held within the automobile, controllably released through a nozzle at the rear. Examples of such toy automobiles are shown in U.S. Pat. Nos. 3,740,896; 3,789,540; 3,936,053; and 4,229,005.

In addition, it is known that projectiles may be launched from a launching barrel or the like by the use of pneumatic means which build up pressure in a reservoir by action of a pump. The projectiles are then launched by quickly releasing the stored fluid pressure within the reservoir against the projectile. Examples of such pneumatic toy projectile launching devices are set forth in U.S. Pat. Nos. 4,159,705 and 4,233,472.

None of the known prior art toy devices disclose the car crash set of the instant invention, wherein children may controllably launch vehicles along intersecting tracks to either collide at the intersection or continue along their tracks until they strike return means. The vehicles then return in the direction they came, either for collision at the intersection, or back to their launchers.

DISCLOSURE OF THE INVENTION

In accordance with the present invention, a toy car crash set is disclosed comprising at least a pair of nonsteerable, unpowered toy vehicles placed on and running along an equal number of tracks which cross at an intersection. A similar number of controllable launching means, activated by players, are located at one end of each track, and an eaual number of return means are located at the other end of each track, opposite the respective launching means. The toy vehicles, either crash at the intersection, or pass through without crashing and strike the return means for return along their tracks, in the direction they came, to crash at the intersection, or to to continue back to their starting points, at the launching means.

BRIEF DESCRIPTION OF THE DRAWINGS

Further objects, features and advantages of the invention will become apparent upon a reading of the specification when taken in conjunction with the following drawings in which like reference numerals refer to like elements in the several views.

BEST MODE FOR CARRYING OUT THE INVENTION

Figure 1:
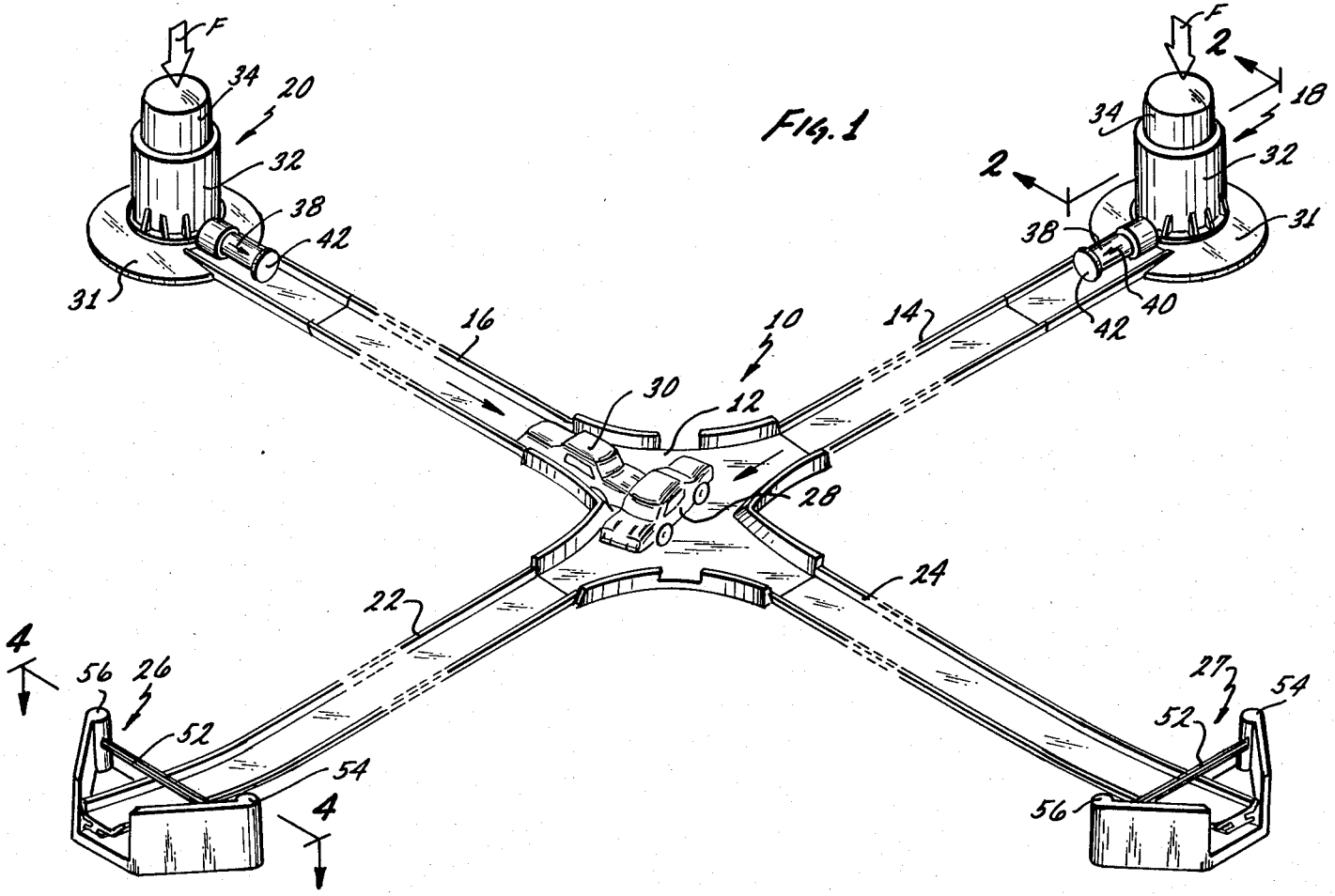
FIG. 1 shows a top perspective view of a toy crash set in accordance with the present invention, in which a pair of nonsteerable, unpowered toy vehicles have crashed at the intersection between two tracks.

Referring now to the drawings, and in particular to FIG. 1, there shown is a crash set 10 including an intersection 12, which is shown as being four way, but which could be made six way, eight way, or more, depending on the desired complexity of the set. Track sections, such as first and second track sections 14, 16 shown, are connected to the intersection at one side thereof to form a pair of tracks. Identical launching means, such as launchers, 18, 20 are connected to the outer ends of each of these track sections. Further track section 22, 24 are connected to the other side of the intersection 12 to form the continuation of each track. These further track sections lead to and are attached to identical elastic return means 26, 27, at the end of each track, opposite a launcher. It is obvious that if other intersections, such as six way or eight way intersections are used, track sections may be connected thereto and launchers and return means placed at the opposite ends of each track thus formed.

The set may include, or may be used with nonsteerable, unpowered vehicles 28, 30, such as the Hot Wheels brand toy vehicles, manufactured and sold by Mattel, Inc., the assignee of the present invention. Each of the nonsteerable, unpowered vehicles may be propelled by any of the launching means used, at varying speeds, determined by the amount of force F applied against the top of the launchers, by a child hitting or pressing on the top. For example, if vehicles are launched simultaneously along each track, and at approximately the same speed from the launchers, the launched vehicles will crash at the intersection, as shown at intersection 12 in FIG. 1. If the vehicles are launched at different times and/or at different speeds the launched vehicles will pass through the intersection without colliding and continue along their respective tracks, until they strike their respective return means at the other end of each track. After striking the return means, the vehicles will rebound or bounce back along their tracks, in the direction from which they came. The rebounding vehicles, will travel in reverse with little or no loss of speed, and be returned to their launchers, unless, of course, they crash at the intersection. When more than two tracks are used, the chances of vehicles colliding at the intersection, in one or more directions, would be increased.

Figures 2, 3:
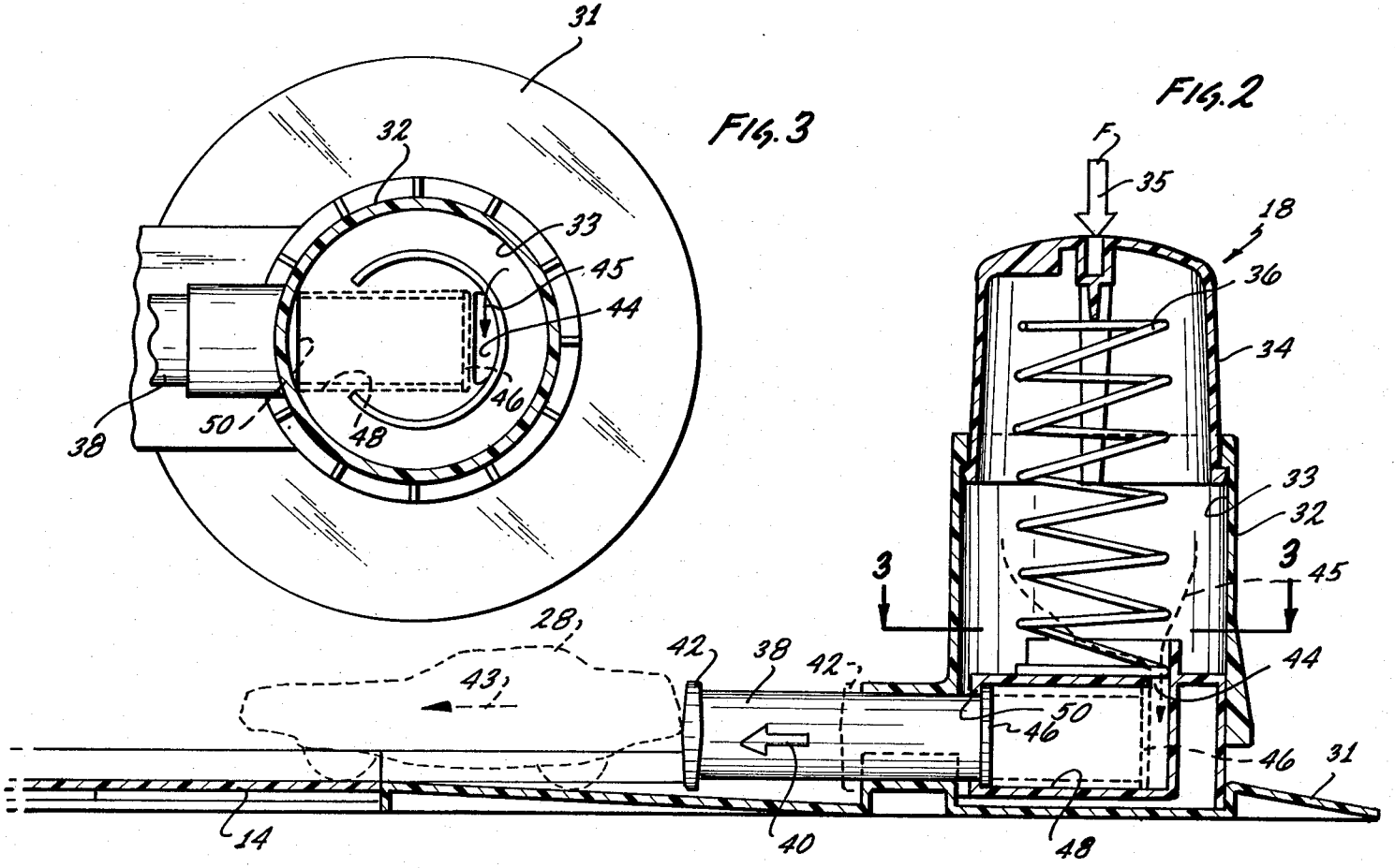
FIG. 2 is an enlarged cross sectional view taken along line 2—2 of FIG. 1, showing the structure of the vehicle launchers.
FIG. 3 is a cross sectional view taken along line 3—3 of the vehicle launcher shown in FIG. 2.

Referring now to FIGS. 2 and 3, all launchers used are substantially identical, and as shown, include an exterior cyclinder 32, preferably extending in the vertical direction, upwardly from a base 31. Fluid, such as air is compressed in the hollow interior 33 of the vertical cyclinder 32 by the action of a large piston 34 operating therein, when the force F is applied in the direction of arrow 35, against the action of an internal compression return spring 36. Downward actuation of the piston 34, quickly expels or extends a smaller, horizontally extending piston 38 in the direction of the arrow 40. Therefore a vehicle, such as 28, shown in phantom line, pressed or resting against outer end 42 of piston 38 will be launched along a track, such as 14 in the direction of arrow 43. The pistons 34 and 38 may be of any size, but preferably have a 5 to 1 compression ratio. This compression ratio allows a child to easily control the speed of a toy vehicle to be launched. In particular, the speed will vary depending on the amount of force applied (how hard the child pushes or strikes) against the top of the piston 34. Air compressed within the hollow interior 33 of cylinder 32 by the downward movement of the piston 34 is forced or pressed through a constricted opening 44 (see arrows 45) to act against an enlarged end 46 of smaller piston 38. This compressed air quickly moves the piston 38 from the pre-launch position, shown in broken line, to the launch position shown in full line. The piston 38 travels within a hollow cylinder 48, formed in the bottom or lower end of cylinder 32, until the end 46 abutts end member 50, formed at the end opposite opening 44.

FIGS. 1 and 4 through 6, show the elastic return means 26, and 27 substantially identical. One of these return means is placed at the end of each track opposite a launcher. An elastic member, such as a rubber strip or band 52 is stretched across the track section 22 leading to and held in the return means. The band is held in this position, in any desired manner, as by a pair of posts 54, 56. The rubber band may be fixed in or to the posts in any convenient manner, and at any desired tension as by being hooked and/or wound around small tabs 58, 60 formed in openings 62, 64 formed within the posts. The track sections are held within, or conversely, the elastic return means are attached to the end of a track section in any convenient manner, as by means of a downwardly extending channel 66 fixed to the bottom of the track section 22 and slideably held on a T-shaped member 68 formed integrally with a base 67 of the return means.

Figure 4:
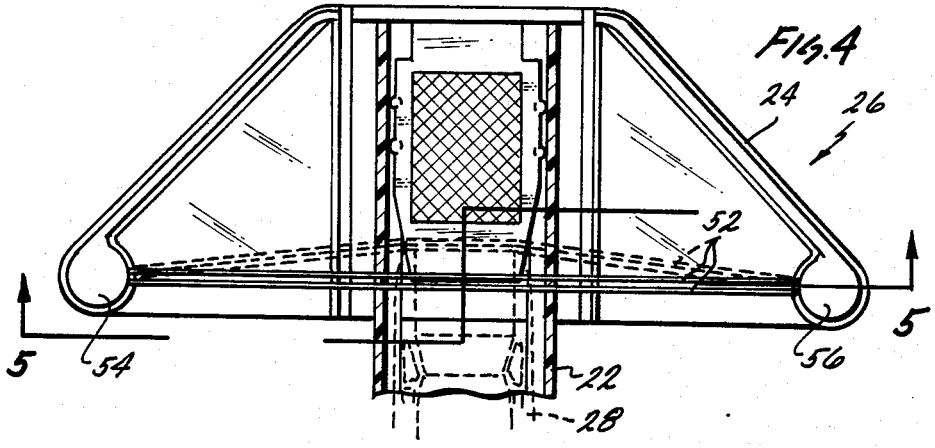
FIG. 4 is an enlarged top elevational view, looking in the direction of line 4—4, showing the return means in greater detail.
Figure 5:
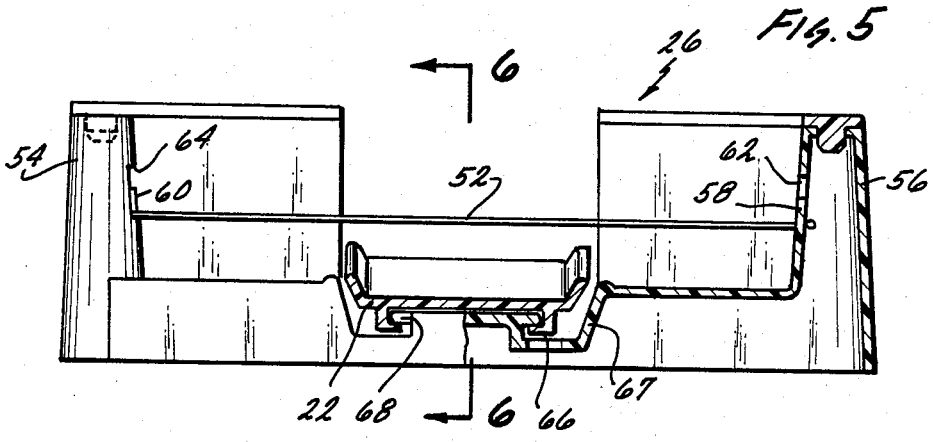
FIG. 5 is a cross sectional view taken along line 5—5 of FIG. 4.
Figure 6:
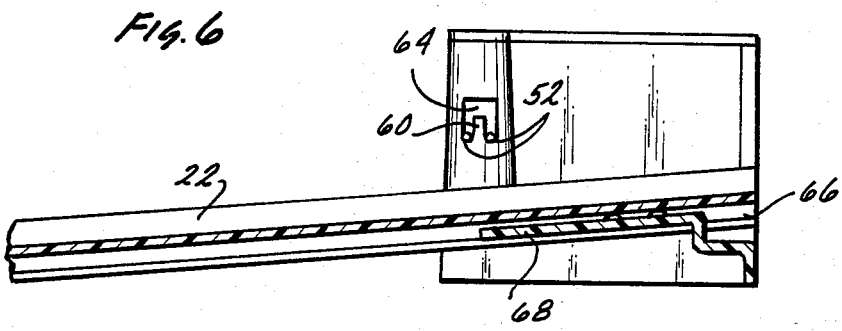
FIG. 6 is a cross sectional view taken along line 6—6 of FIG. 5.

The rubber band 52, when struck by a moving vehicle, such as vehicle 28 shown in FIG. 4, will flex or move to the position shown in broken line, and then cause the vehicle 28 to rebound. The vehicle, travelling in reverse, at substantially the same speed as it contacted the rubber band, moves back toward the launcher at the other end of the track. The vehicle could, of course, crash with another vehicle when crossing the intersection, after rebounding from the return means.

The foregoing description and associated drawings are merely illustrative of the various alternate structures in which the invention may be embodied. Accordingly, the scope of protection of the invention is to be limited only by the scope of the attached claims and to all equivalents to which the invention is fairly entitled.

We claim:

1. A toy car crash set comprising:

at least two nonsteerable unpowered toy cars;

an intersection having at least four ways;

at least two track sections having two ends, one end of each track section connected to the intersection and the other ends thereof leading to and attached to at least two launchers; and at least two elastic return means connected to the outer ends of further track sections having their inner ends connected to the intersection, diagonally opposite from each of the launchers.

2. The toy car crash set of claim 1 wherein each of the launchers includes a large and a small piston, the pistons having a compression ratio of 5 to 1 whereby when the large piston is actuated the small piston will be forced from the launcher against a vehicle resting against the small piston to be launched down a track toward the intersection.

3. The toy car crash set of claim 2 wherein each of the elastic return means includes a rubber band held in position across the end of the track section connected to the elastic return means, by a pair of posts forming part of the return means.

4. The toy car crash set of claim 2 wherein each of the launchers includes an exterior hollow, vertical cylinder, fixed to a base, in which the large piston operates against a compression spring; and a horizontally extending internal hollow cylinder in which the small piston, having two ends operates, the hollow interior of the exterior cylinder being connected by a restricted opening to the hollow interior of the internal cylinder, whereby, upon actuation of the large piston, compressed fluid in the hollow interior of the exterior cylinder will be forced through the restricted opening to act against one of the ends of the small piston and to thereby launch a toy vehicle resting against the other end of the small piston.

5. The toy crash set of claim 3 wherein the rubber band is releasably held within an opening and over a tab formed in each of the posts and whereby the tension of the rubber band may be controlled by the stretching of the rubber band and the winding thereof over the tabs.

* * * * *